US005655744A

United States Patent [19]

Eisman

[11] Patent Number: 5,655,744

[45] Date of Patent: Aug. 12, 1997

[54] DEVICE FOR HOLDING PRINTED MATERIAL

[76] Inventor: Gregg Fredric Eisman, 1903 30th St. #3, San Diego, Calif. 92102

[21] Appl. No.: 430,223

[22] Filed: Apr. 28, 1995

[51] Int. Cl.[6] ..... A47B 23/00

[52] U.S. Cl. ..... 248/445; 248/444.1

[58] Field of Search ..... 248/445, 444.1, 248/172, 670, 672, 676, 451, 188.1, 163.1

[56] References Cited

U.S. PATENT DOCUMENTS

| | | | |
|---|---|---|---|
| 3,894,709 | 7/1975 | Weir | 248/445 |
| 4,117,781 | 10/1978 | Middleton et al. | 248/445 X |
| 4,431,156 | 2/1984 | Mena | 248/445 |
| 4,718,630 | 1/1988 | Richard | 248/445 X |
| 4,793,633 | 12/1988 | Rose | 281/45 |
| 5,040,760 | 8/1991 | Singer | 248/670 X |
| 5,129,616 | 7/1992 | Carson | 248/445 X |
| 5,351,927 | 10/1994 | Howell | 248/444.1 |
| 5,485,980 | 1/1996 | Luccia | 248/445 |

FOREIGN PATENT DOCUMENTS

| | | | |
|---|---|---|---|
| 2150018 | 11/1983 | United Kingdom | A47B 23/00 |

*Primary Examiner*—Terry Lee Melius
*Assistant Examiner*—Robert Pezzuto

[57] ABSTRACT

The present invention is a device for holding printed material over a viewer laying supine such that the material can be viewed from below and overhead illumination is reduced. The device comprises two horizontal supports slidably affixed to at least two rods so that they may be adjusted to accept most viewing material. These supports have a slip resistant coating so that the viewing material is held firm during viewing. At least one vertical support comprising two vertical, parallel legs connected by a horizontal leg support is rotatably affixed to the material support such that the device may be collapsed and easily hand carried.

7 Claims, 6 Drawing Sheets

DEVICE FOR HOLDING PRINTED MATERIAL

TECHNICAL FIELD

The present invention relates to devices for holding printed material in a position such that the printed material may be viewed. More particularly, the present invention relates to a device that holds printed material so that it may be viewed without being continuously held by the viewer.

BACKGROUND OF INVENTION

Currently there are several devices available to the consumer which are designed to support printed material in an inclined position, on a level surface, so they may be easily read by the viewer. Such devices are typically a wire frame support with legs that fold inward so that the device may be easily transported. These supports have the advantage of allowing the viewer to read or view material without having to hold the material. This leaves the viewers hands free to perform other functions, as well as eliminating the need to support the material while being viewed. These devices are generally designed so that they are portable and may be collapsed for ease of transport. However, when a solid level surface is not available these devices cannot be used. The primary reason is that the design of the support requires that weight of the viewing material be centered on the device. If used on a unlevel surface, the device is unstable and will have a tendency to tip forward or backward. For example, such a device could not be used to hold material while the viewer is sitting in a chair or laying in bed without a flat surface on which to set the device, such as a table.

Other devices have been developed which allow the viewer to view material through a translucent plastic surface when the viewer is laying down in a supine position. These devices require the viewer to place the printed material face down on top of the translucent surface such that the material may be read through the translucent plastic surface. One difficulty with these devices is that they must generally be affixed to the structure on which the viewer intends to lay, for example, a bed. In addition, the plastic surface or other transparent surface is susceptible to scratching and discoloring which, over time, may make viewing more difficult. This susceptibility prevents practical use of these devices outside the home where sun, rain and sand could damage the transparent surface more quickly. Another disadvantage is that these devices are not mobile and cannot be easily transported from one location to another.

Another device currently in use for such purposes comprises a pedestal having wheels with a rotatable flat surface mounted to the pedestal top. The printed material is held in place against the rotatable surface by the use of a transparent plastic window. The device has the advantage of being able to be adjusted so that the printed material may be viewed while the viewer is in a upright or laying position. The device has a further advantage of being able to be moved from one room to another. However, because it uses a transparent window this device has the same disadvantages as that stated above. In addition, because of its bulky design, it cannot be easily transported from one geographical location to another.

Consequently, there is a need in the field for a device that is able to hold material without the use a transparent surface, that may be used on unlevel surfaces, that may be used outside the home, and may be easily transported from one geographical location to another.

SUMMARY OF INVENTION

The present invention is a device for holding printed material over a viewer laying supine such that the material can be viewed from below. Within one aspect of the invention the device comprises a material support comprising a first and a second horizontal support adjustably separated by at least two rods, wherein at least one of the horizontal supports comprises a slip resistant coating on a surface for holding the printed material; and at least one vertical support comprising two vertical, parallel legs wherein the vertical support(s) are connected to the material support.

Within another aspect of the invention the material support further comprises at least two material supports adjustably separated by the rods wherein at least one of the material supports comprises a slip resistant coating on a surface for holding the printed material; and two vertical supports further comprising a horizontal leg support connecting the two parallel legs of the vertical support wherein the vertical support(s) are movably connected to the material support.

Within one embodiment of the invention, the material support, vertical support(s), and horizontal leg support(s) are made of a material selected from the group consisting of plastic, graphite, metal, carbon fiber, composite material and wood. Within another embodiment the rods are made of a material selected from the group consisting of carbon fiber, metal and plastic. Preferably the rods are made of metal.

Within yet another embodiment, the slip-resistant coating is selected from the group consisting of silicone, neoprene, and plastic. Preferably, the slip-resistant coating is made of rubber.

Within still another embodiment of the invention a restraining strap is affixed to at least one rod such that the printed material is held in place while viewing.

In another aspect of the invention, the vertical supports further comprise an upper leg portion, a lower leg portion and an adjustable means. The adjustable means is positioned between the upper leg portion and lower leg portion of the vertical leg support so that the lower leg portion may be rotated upward toward the material support structure parallel to the upper leg portion of the vertical support structure.

DETAILED DESCRIPTION

Figure 1:
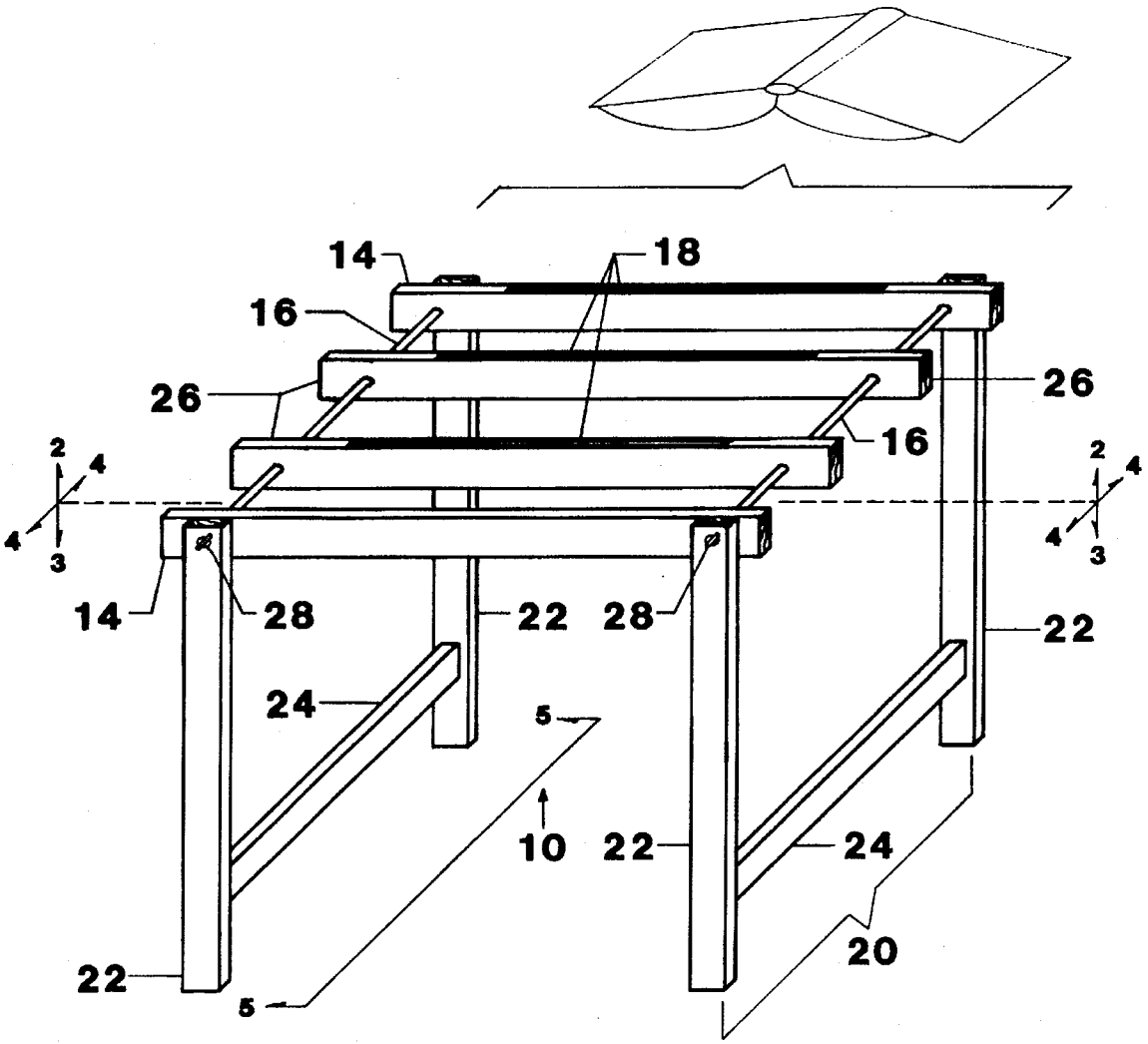
FIG. 1 is a perspective view of a device of the present invention to hold material to be viewed and a book used in conjunction with the present invention.
Figure 2:
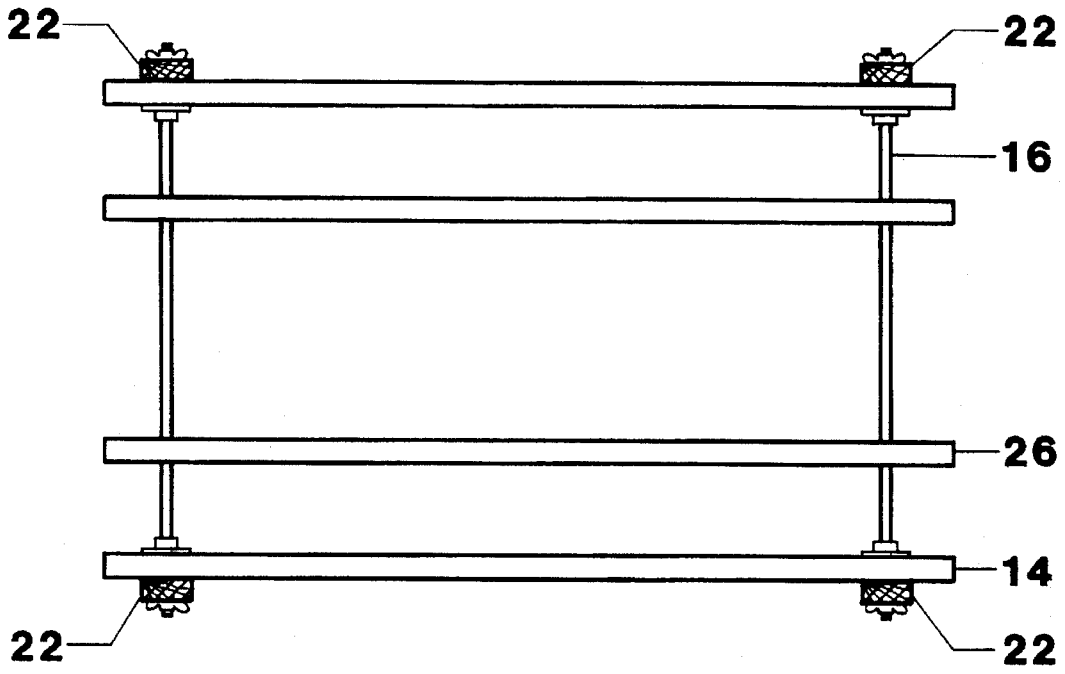
FIG. 2 is a sectional view taken in the plane of line 2—2 of FIG. 1.
Figure 3:
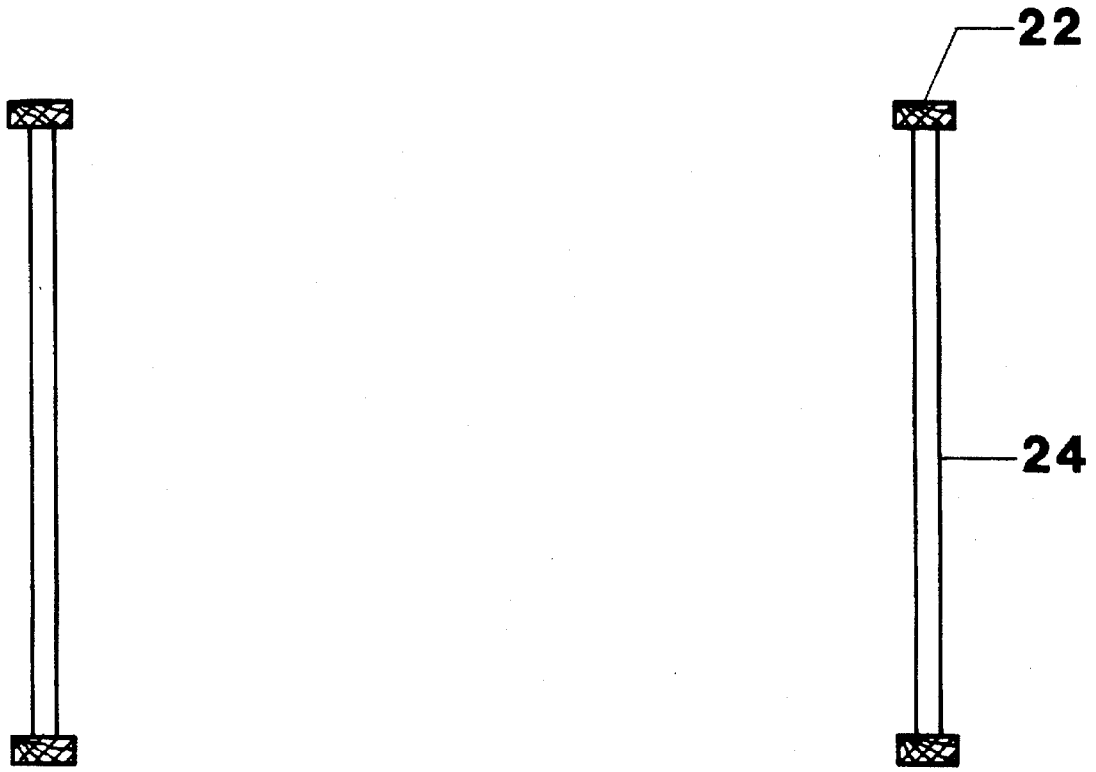
FIG. 3 is a sectional view taken in the plane of line 3—3 of FIG. 1.
Figure 4:
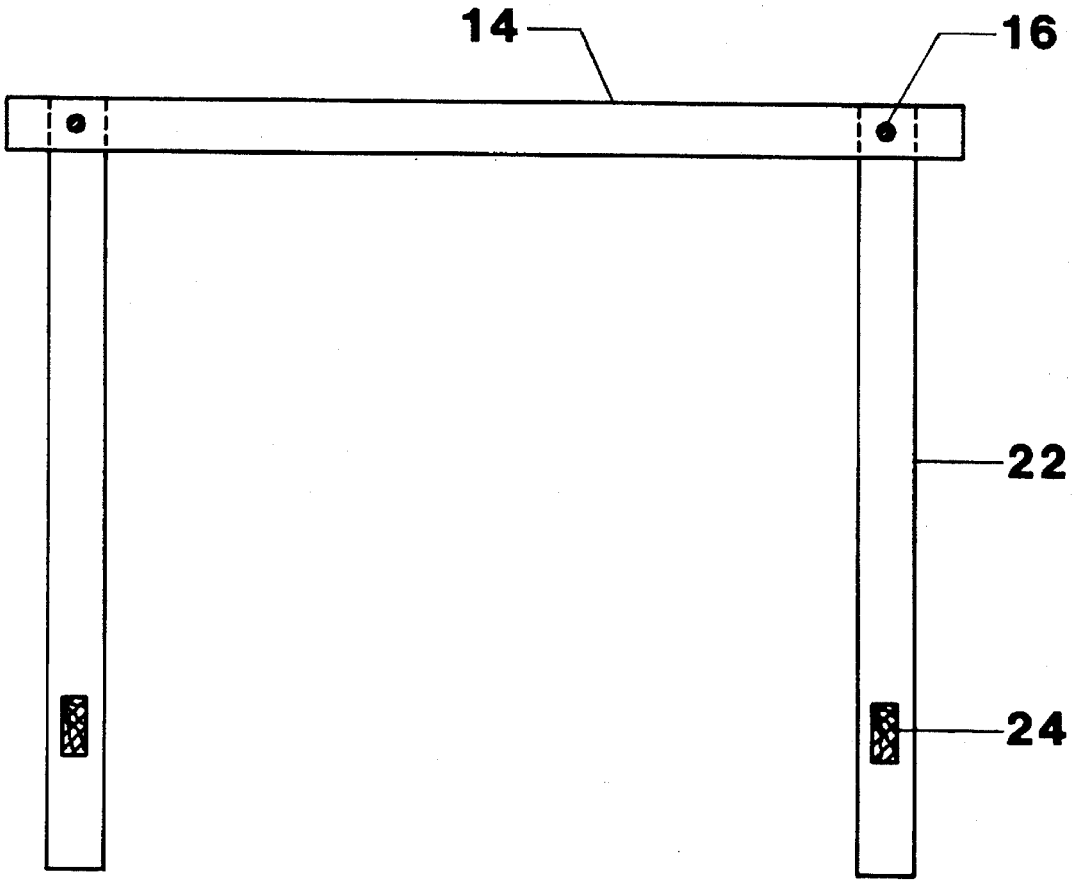
FIG. 4 is a sectional view taken in the plane of line 4—4 of FIG. 1.
Figure 5:
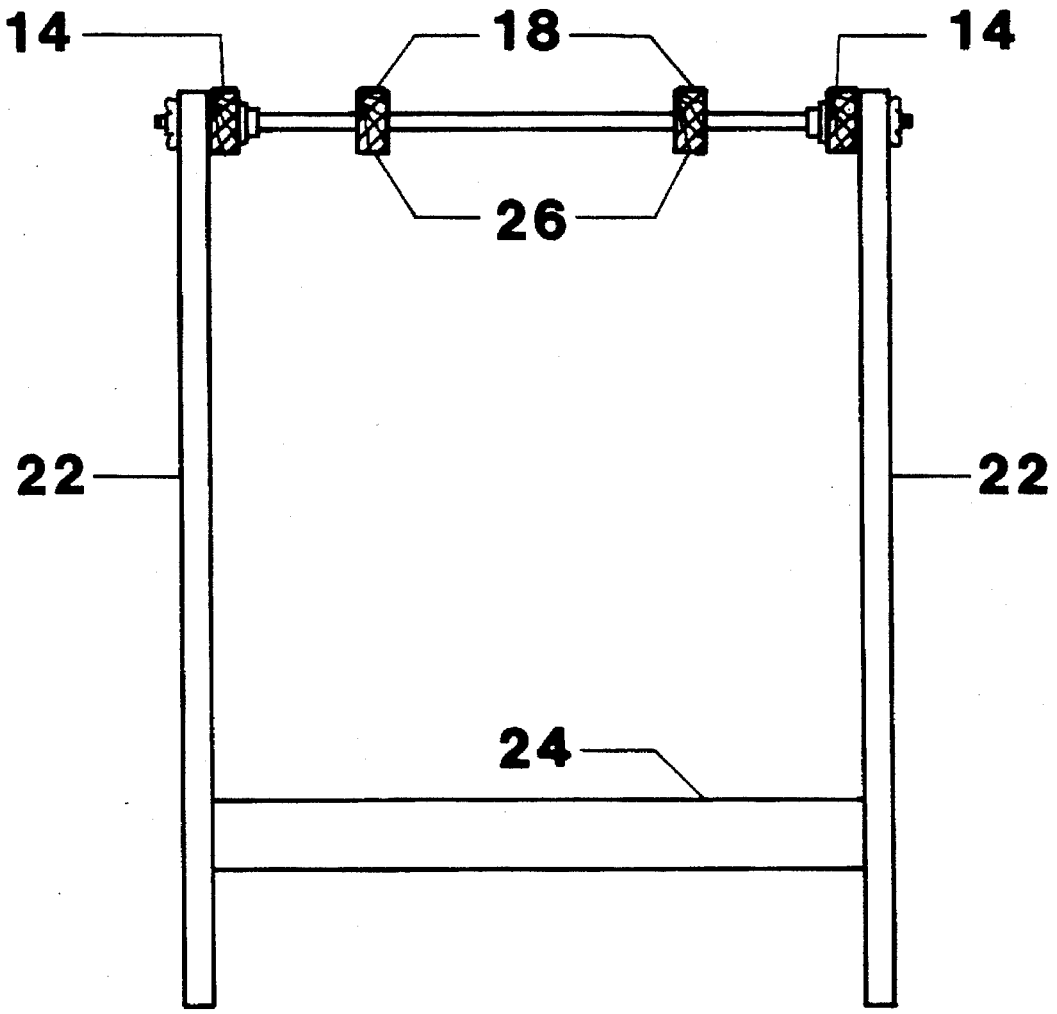
FIG. 5 is a sectional view taken in the plane of line 5—5 of FIG. 1.
Figure 6:
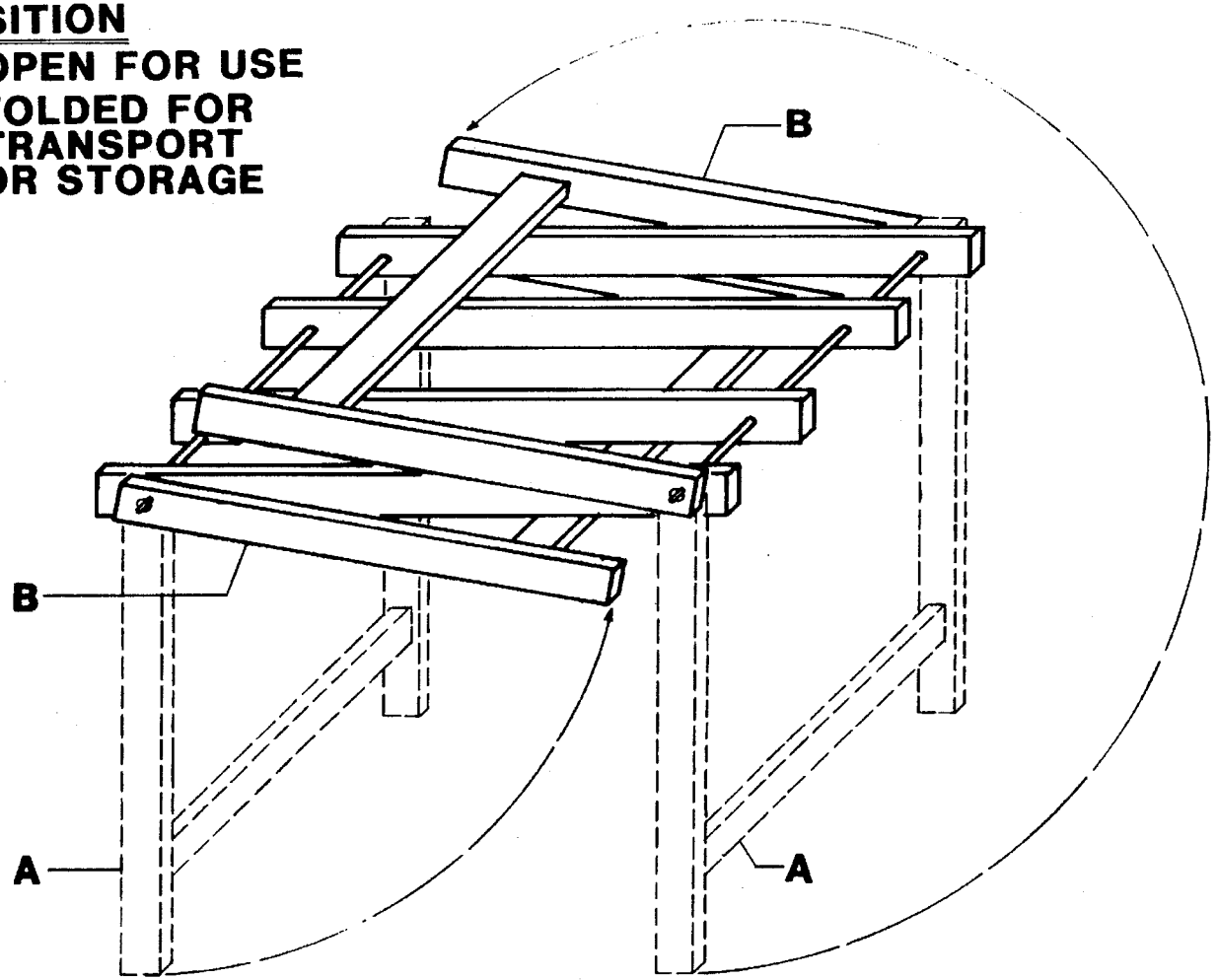
FIG. 6 is a perspective view of the device in FIG. 1 folded for ease of transport.

A device for holding printed material 10 is seen in FIGS. 1 through 6. The device permits the viewer, while laying in a supine position underneath the device 10, to view material placed on the material support structure 12. The material support structure 12 comprises at least one horizontal support 14 adjustably separated by at least two rods 16, wherein at least one of the horizontal supports 14 comprises a slip resistant coating 18 on a surface that will contact the printed material.

Two horizontal supports 14 are preferred. These supports may be constructed of a variety of materials including a metal plastic, wood, carbon fiber, or composite material. The supports 14 are preferably made of a light weight metal or wood material, for example aluminum, redwood or pine.

The rods 16 may be constructed of metal; plastic, carbon fiber or other suitable material. Preferable, the rods 16 are made of a metal, most preferably a metal that is resistant to corrosion or has been treated such that it is resistant to corrosion. The rods 16 may also be coated with a material that decreases the free movement of the horizontal supports 14 but allows the user to adjust the supports 14 to accept many different sizes of viewing material. The rods 16 are positioned through the material support structure 12 including the horizontal supports 14 and the vertical support(s) 20. At least one end of each rod 16 comprises an adjustable means so that the vertical supports 20 may be rotated. For example, the end of each rod 16 may be threaded to accept a wing nut 28 and a stop is positioned at each end such that upon loosing the wing nut the vertical supports 20 may be rotated inwardly toward the material support structure 12 or rotated outwardly to an open position and upon tightening the wing nut the vertical supports 20 are tightened against the stops locking the supports 20 in a desired position. Preferably, both ends of each rod 16 are threaded to accept wing nuts 28 thereby permitting rotation of the vertical supports 20 on either side of the material support structure 12.

In one embodiment of the invention a restraining strap may be affixed slidably to a rod 16 to hold the printed material in place. The other end of the restraining strap having a means for attaching to the other rod. The attaching means maybe a hook or a clamp and maybe made of metal or plastic. The restraining strap may be made of an elastic material or a non-elastic material. In one embodiment the restraining strap comprises a weight or is made of a weighted material such that the strap when laid across the printed holds the printed material in place.

In another embodiment a handle is affixed to one rod such that the device maybe easily hand carried. The handle is preferably slidably affixed to the rod 16 and maybe made of wood, plastic, nylon, composite material or metal.

At least one horizontal support 14 is coated with a slip resistant material 18. The slip resistant material 18 is affixed to a surface of the horizontal support 14 that contacts the material to be viewed. Preferably, each horizontal support 14 has a slip resistant material 18 on a surface that contacts the material being viewed. The slip resistant material 18 may be one continuous strip or two or more non-continuous pieces of suitable material. A variety of materials may be used that prevent slipping and sliding of the viewed material, for example, rubber, foam rubber, silicone, or plastic. Preferably the slip resistant material 18 is rubber.

The material support structure 12 may be supported by one or more vertical support structure(s) 20. If one vertical support structure 20 is used, the parallel legs 22 of the vertical support 20 may terminate in an elongated cone shape such that the parallel legs 22 may be pressed into the ground when using this device outside. The two parallel legs 22 are preferably affixed to a horizontal leg support 24 that may be used to drive the parallel legs 22 into the ground by applying pressure with a foot or hand. Preferably, the material support structure 12 is supported by at least two vertical support structures 20 having two parallel legs 22 affixed to a horizontal leg support 24. The vertical support structure 20 may be constructed of a variety of materials including metal, plastic, wood, carbon fiber, or composite material. The supports 20 are preferably made of a light weight metal or wood material. For example, aluminum, redwood, or pine.

In another embodiment of the invention the vertical support structure 20 may be comprised of an upper leg portion and a lower leg portion, the lower leg portion being attached to the upper leg portion by an adjustable means such that the lower leg portion of the vertical support structure comprising the horizontal leg support maybe rotated upward toward the material support structure 12 and parallel to the upper leg portion of the vertical support structure 20. For example, the lower leg portion of the vertical support structure 20 comprising the horizontal leg support 14 may be affixed to the upper leg portion by bolts threaded to accept wing nuts such that upon loosening the wing nuts the lower leg portion maybe rotated outwardly to an open position or inwardly toward the upper leg portion of the vertical leg support structure 20. The lower leg portion of the vertical leg support structures may be made of the same material as that described for the vertical leg support structure and are set into position by tightening the wing nuts.

Within another embodiment of the invention, the device comprises two horizontal supports 14 separated by at least two rods 16 and at least two material supports 26 which can be adjustably separated along the rods 16 to accommodate a variety of different sized viewing materials. The material supports 26 may be affixed to the rods 16 by a connector which allows the material supports 26 to move along the rod 16 and adjusted to accept viewing material. Preferably, the rods 16 are fitted through the material supports 26 such that the material supports 26 can be adjusted along the rods 16 to accommodate the material being viewed. The material supports 26 may be constructed of a variety of materials including metal, plastic, wood, carbon fiber, or composite material. The supports 26 are preferably made of a light weight metal or wood material. For example, aluminum, redwood, or pine.

I claim:

1. A device for holding printed material over a viewer laying supine such that the material can be viewed from below the device, the device comprising:

a material support having at least two fixably attached substantially horizontal support members and first and second substantially horizontal moveable support members adjustably separated by at least two rods;

wherein all support members exist in substantially parallel relationship to one another with the moveable support members between the fixably attached support member;

wherein the at least two rods terminate with and are rigidly secured in a perpendicular relationship to the fixably attached horizontal support members and are slidably attached to the moveable support members;

a slip resistant coating applied to a material contact surface of at least one of the fixably attached members or the moveable support members;

at least one vertical support assembly comprising at least two vertical legs and a horizontal leg support connected therebetween wherein the legs are parallel to one another and wherein the vertical support assembly is connected to the material support.

2. The device according to any of claim 1 wherein the material support and vertical support and horizontal leg support are made of a material selected from the group consisting of plastic, wood, graphite, metal, carbon fiber and composite material.

3. The device according to any of claim 1 wherein the vertical supports are rotatably connected to the material support.

4. The device according to any of claim 1 wherein the rods are made of a material selected from the group consisting of carbon fiber, metal and plastic.

5. The device according to any of claim 1 wherein the slip-resistant coating is selected from the group consisting of rubber, foam rubber, silicone and plastic.

6. The device according to any of claim 1 wherein the device further comprises a restraining strap affixed to at least one rod.

7. The device according to any of claim 1 vertical support assembly further comprises an upper leg portion, a lower leg portion, and an adjustable means, the adjustable means positioned between the upper leg portion and lower leg portion such that the lower leg portion may be rotated upward toward the material support structure parallel to the upper leg portion of the vertical support structure.

* * * * *